United States Patent [19]

Almqvist

[11] Patent Number: 4,678,030

[45] Date of Patent: Jul. 7, 1987

[54] PLATE HEAT EXCHANGER

[75] Inventor: Christer Almqvist, Täby, Sweden

[73] Assignee: Reheat AB, Taby, Sweden

[21] Appl. No.: 802,823

[22] Filed: Nov. 29, 1985

[30] Foreign Application Priority Data

Jun. 6, 1985 [SE] Sweden ..... 8502802

[51] Int. Cl.[4] ..... F28F 3/04

[52] U.S. Cl. ..... 165/166; 165/167

[58] Field of Search ..... 165/166, 167

[56] References Cited

U.S. PATENT DOCUMENTS

| | | | |
|---|---|---|---|
| 4,176,713 | 12/1979 | Fisher | 165/166 |
| 4,284,135 | 8/1981 | Almqvist et al. | 165/166 |
| 4,307,779 | 12/1981 | Johansson et al. | 165/167 X |
| 4,359,087 | 11/1982 | Johansson | 165/167 |
| 4,376,460 | 3/1983 | Skoog | 165/167 |

*Primary Examiner*—Albert W. Davis, Jr.
*Attorney, Agent, or Firm*—Holman & Stern

[57] ABSTRACT

Plate heat exchanger in the form of several heat exchanger plates (1) placed close to and sealed against each other and having pressed-out ridges (4) to form the heating surface of the relative plate in order to provide two different flow passages in the same plate heat exchanger. The plate heat exchanger according to the invention consists of identically like heat exchanger plates (1), the packing groove (9) of which has its bottom placed in the central plane of the plate (1). The heating surface of the relative plate is further divided into at least two area portions (5–8), the ridges (4) in one area portion (5) having an angle ($\alpha_1$) relative to the symmetry axes (X and Y, respectively) of the plate lying in its plane, which is different from the angle ($\beta_1$) formed by the ridges (4) in the other area portion (6) with the symmetry axes and that one or more of the other plates included in the heat exchanger are turned 180° about one of said symmetry axes (x, Y) starting from the orientation of one plate in the plate heat exchanger.

4 Claims, 6 Drawing Figures

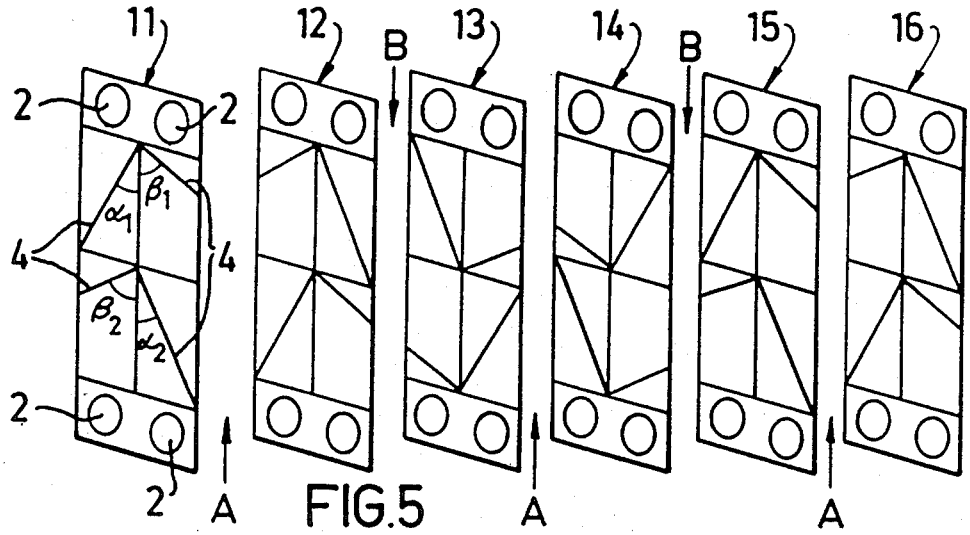
FIG.5
FIG.6
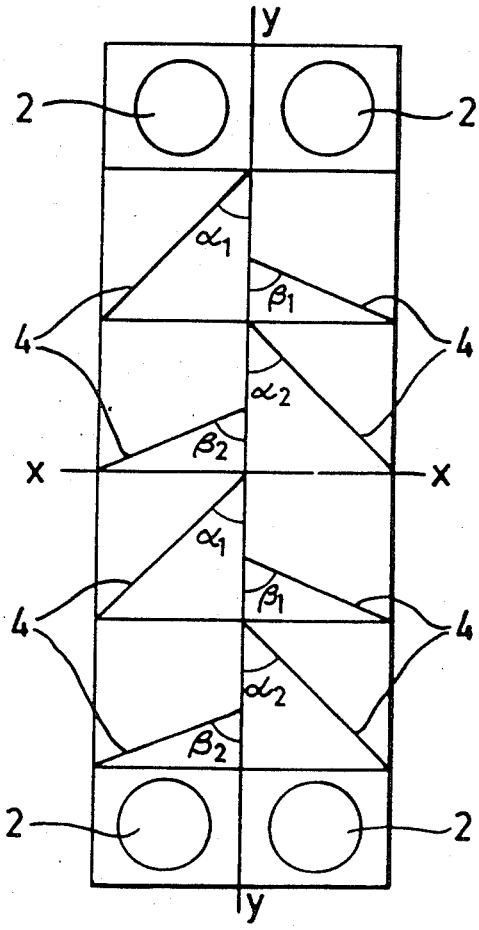

PLATE HEAT EXCHANGER

BACKGROUND OF THE INVENTION

This invention relates to a plate heat exchanger in the form of several heat exchanger plates placed closed to and sealed against each other, which are provided with pressedout ridges to form the heating surface of the relative plate.

SUMMARY OF THE INVENTION

It is intended by the invention to provide two different flow passages in the same plate heat exchanger, which passages can arbitrarily be selected for both the media flowing in the plate heat exchanger.

Due to high manufacturing costs of pressing tools for heat exchanger plates and costs of storage of such plates it is neccessary for a manufacturer to restrict the plate assortment. However, at the same time it is desired to provide such a great number of variations or variants of plate channels as possible in a plate heat exchanger so that a heat exchanging task can be solved with the least possible heating surface which desideratum, however, is very difficult to satisfy due to the limited plate assortment.

Thus, it is possible today to vary the plate channels in the same plate heat exchanger which, however, is done with different types of plates.

It is possible by the present invention, such as it is apparent from the characterizing portions of the claims, to form two different flow passages using only one type of plate in the plate heat exchanger, the plates being turned in three different ways relative to one another.

DETAILED DESCRIPTION OF THE INVENTION

Figure 1:
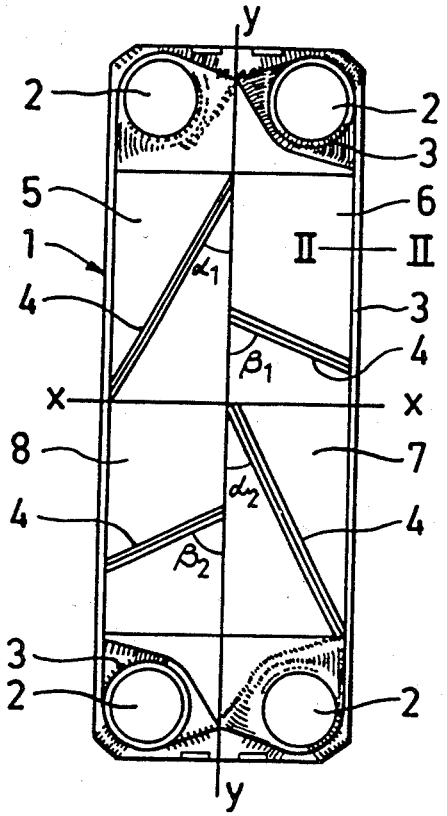
Figure 2:
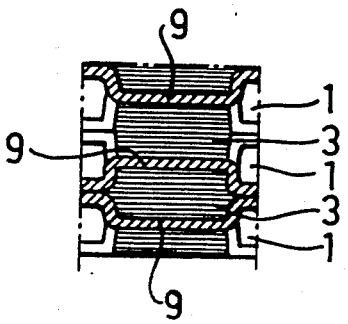
Figure 3:
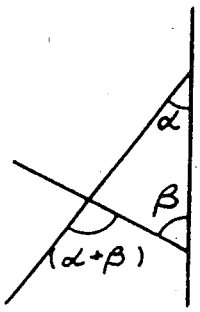
Figure 4:
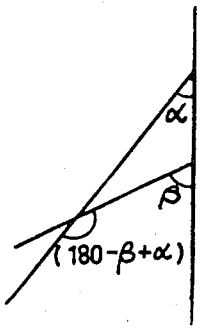

The invention will be described more in detail in the form of examples with reference to the drawing, wherein FIG. 1 shows schematically a heat exchanger plate according to the invention, FIG. 2 a part section taken on line II—II in FIG. 1, FIGS. 3 and 4 show very schematically two examples of how the ridges of two adjacent heat exchanger plates extend relative to each other, FIG. 5 shows schematically and in an explosive view the placement of six heat exchanger plates in a plate heat exchanger and FIG. 6 shows schematically another embodiment of a heat exchanger plate.

In FIG. 1 a heat exchanger plate 1 in accordance with the invention is shown. The plate 1 is in conventional manner provided with openings or ports 2 and packing grooves 3 for edge packings and packings around two of the ports. The heat exchanger plate 1 is further provided with parallel, pressed-out ridges 4 forming the heating surface of the plate. It is understood that not all the ridges are drawn in the figure. The heating surface of the heat exchanger plate is divided into four area portions 5–8, the ridges 4 in the area portion 5 intersecting the Y-axis of the plate at an angle $\alpha_1$, in the area portion 6 the Y-axis at an angle $\beta_1$, in the area portion 7 the Y-axis at an angle $\alpha_2$ and in the area portion 8 the Y-axis at an angle $\beta_2$.

FIG. 2 shows a part section taken on line II—II in FIG. 1, three adjacent plates being drawn. The packing groove 9 has its bottom placed in the central plane of the heat exchanger plate 1, which is known per se. By this location of the packing groove 9 a plate can be turned 180° in three different directions relative to an adjacent plate. Thus, the plate can be turned in its own plane, around its longitudinal axis (Y-axis) and its width axis (X-axis). The sealing surfaces of the packing grooves in adjacent plates will be equal in all three cases.

The plate patterns around the packing grooves are not shown in the figures and it is to be understood that the corrugations in these areas are so formed that the required support points between adjacent plates are obtained at a mutual turning of these.

In order to describe the formation of different plate channels it is referred to FIGS. 1, 3 and 4. Assuming that a similar plate is adapted close to a plate according to FIG. 1 and turned 180° about its X-axis. The arrow angles of the pressed-out ridges in the heating surface will then point in a direction contrary to the turned plate as compared with the starting plate according to FIG. 1. If the plate, on the other hand, is turned about its Y-axis, the arrow angles will have the same direction as the arrow angles in the original plate according to FIG. 1. In order to simplify the description of the invention it is assumed that the angles $\alpha_1=\alpha_2$ and $\beta_1=\beta_2$ and only one of the four area portions of the heating surface is considered, because the ridges of two adjacent plates will intersect each other equally in all four portions of the heating surface. In FIG. 3 a plate is shown as turned about the X-axis, the ridges intersecting each other at an angle $(\alpha+\beta)$. FIG. 4 shows the corresponding thing but with the plate turned 180° about the Y-axis, the angle between the ridges of the plates being $(180-\beta+\alpha)$. In the practical embodiment the angles $\alpha$ and $\beta$ should be selected with respect to the desired thermal length of the channel, the demand for a sufficient number of support points being considered. The angle between the intersecting ridges has a considerable influence on the flow properties of the plate channel.

One skilled in the art will realize from the above that several combination possibilities are present by means of the invention to form flow passages in the finished plate heat exchanger so that e.g. one of the media passes merely in one type of flow channel and the other medium merely in the other type of flow channel, i.e. quite asymmetrical channels can be obtained for the two media. The plate assembly can also be arranged for each of the media so that one medium flows in both types of flow channels. The combination possibilities of the different flow channels are described more closely in the form of an example of a quite asymmetrical plate assembly according to FIG. 5. All the plates are identical here and correspond to the plate shown in FIG. 1, the plates however being designated by the numerals 11–16. It is assumed that the plate 11 has the same orientation as the plate shown in FIG. 1. The adjacent plate 12 has been turned about its Y-axis. The arrow angles of the ridges will point in the same direction between plate 11 and plate 12. A flow passage is formed between the plates 11 and 12 for one medium, the medium A. The plate 13 is the plate according to FIG. 1 turned 180° in its own plane. A flow passage of the other medium, medium B, is then obtained, which passage has oppositely directed arrow angles. Plate 14 is a plate 1 turned 180° about the X-axis and the arrow angles between plate 13 and plate 14 will point in the same direction. Plate 15 has the same orientation as plate 11. The arrow angles of the ridges will be directed in opposite directions between plate 14 and plate 15. Plate 16 is turned 180° about its Y-axis and the arrow angles of the ridges point in the same direction as at plate 15. The plates 11, 13 and 15 have their sides—heating surfaces—in the same direction and in the example as shown in FIG. 1. With respect to this side or heating surface the plates 12, 14 and 16 are turned in the other direction.

As is well-known to one skilled in the art the media will flow via selected ports 2 in every other plate channel, e.g. the medium A will flow in the plate channels formed between the plates 11 and 12, the plates 13 and 14 and the plates 15 and 16. The medium B will flow in the space between the plate 12 and 13 and the plates 14 and 15. The flow passages of the medium A have the arrow angles of the ridges in the same direction whereas the channels in which the medium B is flowing, have counterdirected arrow angles of the adjacent plates. Thus, FIG. 5 shows a plate heat exchanger where the medium A flows merely through one sort of flow passages and the medium B merely through another sort of flow passages.

It is clearly realized by one skilled in the art from the above that it is possible by means of only one type of heat exchanger plate to build a plate heat exchanger capable of satisfying approximately the demands that may be required.

The plate can of course be designed in several ways within the scope of the invention maintaining only one type of heat exchanger plate with the economical advantages brought by this. In FIG. 6 a plate having eight different area portions is shown. In the example shown the four upper area portions agree in principle with each other as well as the four lower area portions, being similar in principle the area portions of the plate according to FIG. 1. This means quite practically that the four upper portions are pressed in one step in the manufacture of the plate and in next step the four lower portions are pressed.

The number of area portions and the size of arrow angles can of course be varied within the scope of the invention. It must however be presupposed that said area portions must not form mirror images about one of the symmetry axes lying in the plane of the plate.

What I claim is:

1. A plate heat exchanger comprising: a plurality of heat exchanger plates placed close to and sealed against each other and having respective pressed-out ridges to form a heating surface of each respective plate including two different flow passages forming a heat exchanger body wherein said heat exchanger plates are generally alike, a packing groove having a bottom disposed in a central plane of each said plate, said heating surface being divided into at least two area portions, ones of said ridges in one area portion having a first angle relative to symmetry axes X and Y, respectively of said plate lying in a plane of said plate which is different from a second angle formed by ones of said ridges in the other said area portion with symmetry axes thereof and one or more of the other ones of said plates included in said heat exchanger body being disposed at an angle of approximately 180 degrees about one of said symmetry axes (x,y) starting from the orientation of one plate in said heat exchanger body;

and wherein said symmetry axes of said plate included in said heat exchanger body defines four area portions.

2. A plate heat exchanger according to claim 1, wherein said first and second angles and a third and a fourth angle respectively between said ridges and said Y-axis are equal in the area portions lying diagonally relative to each other.

3. A plate heat exchanger according to claim 1, wherein every other plate has its heating surface in a same direction but alternatively turned by an angle of 180° in its plane, and each remaining said every other plate is alternatively turned by an angle of 180° about said symmetry axis relative to a first plane of the other plates.

4. A plate heat exchanger as claimed in claim 1, wherein at least one of said heat exchanger plates is disposed so as to be rotated relative to other ones of said generally alike heat exchanger plates, by 180 degrees about a Z-axis, said Z-axis also being a symmetry axis of said heat exchanger plates, said Z-axis lying in a respective said plane of said heat exchanger plate which is disposed so as to be relatively rotated; said X, Y, and Z symmetry axes being mutually perpendicular to one another, such that said ridges of any one plate are disposed at mutually different angles depending upon which of said symmetry axes has been used as an axis of rotation;

whereby said ridges of any plate can be disposed at any one of at least three different predetermined angles relative to adjacent ones of said heat exchanger plates.

* * * * *